United States Patent [19]

Buss

[11] Patent Number: 5,001,614

[45] Date of Patent: Mar. 19, 1991

[54] FLOOR LAMP APPARATUS

[76] Inventor: John Buss, 9961 No. Cooper Creek Rd., Free Soil, Mich. 49411

[21] Appl. No.: 391,792

[22] Filed: Aug. 9, 1989

[51] Int. Cl.[5] ..... F21S 3/00; F21V 1/00

[52] U.S. Cl. ..... 362/225; 362/248; 362/249; 362/260

[58] Field of Search ..... 362/217, 225, 248, 249, 362/260, 410, 413, 418

[56] References Cited

U.S. PATENT DOCUMENTS

| | | | |
|---|---|---|---|
| 2,216,084 | 9/1940 | Libson | 362/225 |
| 2,792,491 | 5/1957 | Rand | 362/410 X |
| 2,956,149 | 10/1960 | Dowell et al. | 362/219 |
| 3,509,334 | 4/1970 | Michailov | 362/413 |
| 4,658,337 | 4/1987 | Burke | 362/225 |
| 4,744,016 | 5/1988 | Lindberg | 362/413 X |

*Primary Examiner*—Stephen F. Husar
*Assistant Examiner*—Peggy A. Neils
*Attorney, Agent, or Firm*—Eckert, Seamans, Cherin & Mellott

[57] ABSTRACT

A floor lamp apparatus is provided in which an elongated lightbulb, preferably a fluorescent lightbulb, is supported above the floor. The apparatus is preferably triangular, the first and second sides of the triangle forming a support structure, and the elongated lightbulb being fixed along the third side. The elongated lightbulb can thereby be supported above the surface by either of the first and second sides, and at different angles relative to the surface. The invention is particularly useful to detachably support fluorescent light units of the type having at least one elongated fluorescent lightbulb fixed to an elongated channel housing. a cradle can be formed in the third side to receive and retain the channel housing. Adjacent sides are preferably detachable, or pivotally connected, to permit convenient folding and storage of the apparatus.

12 Claims, 6 Drawing Sheets

FIG. 13a
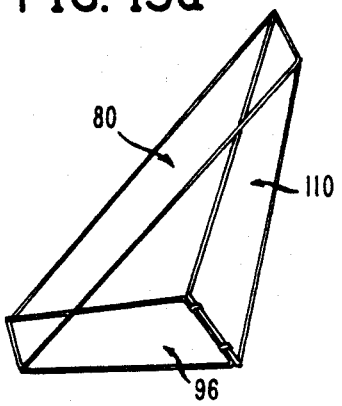
FIG. 13b
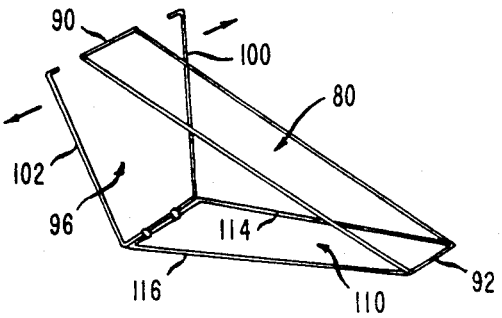
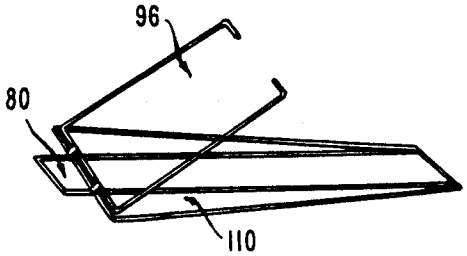
FIG. 13c
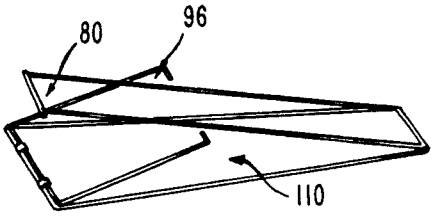
FIG. 13d
FIG. 14
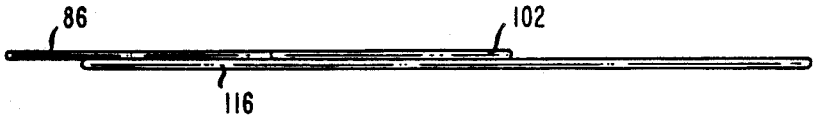
FIG. 15
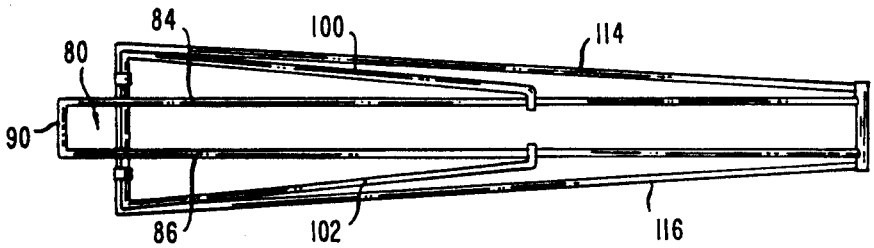

FIG. 16
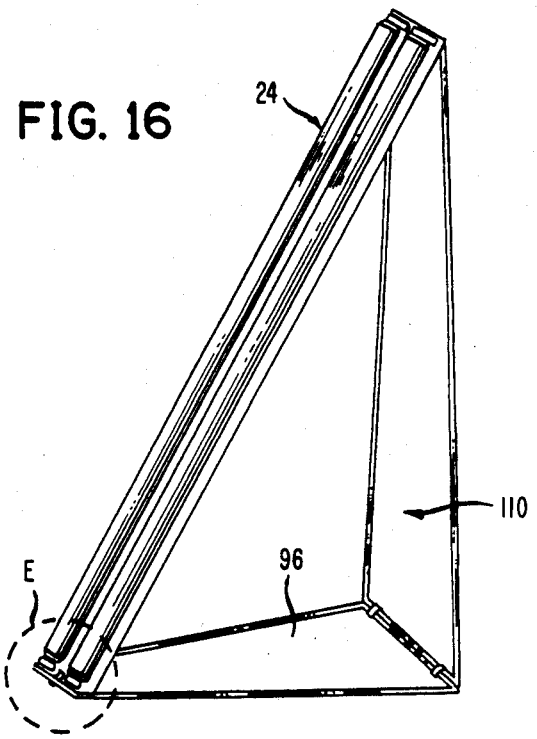
FIG. 17
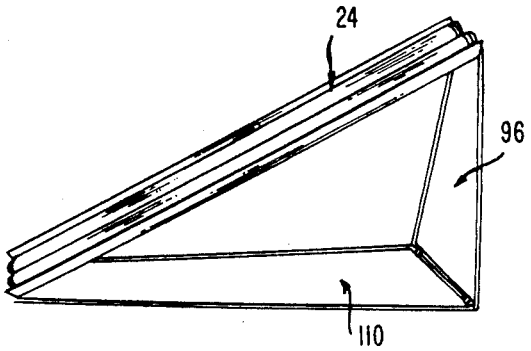
FIG. 19
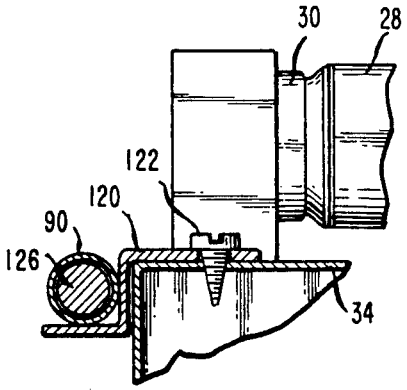
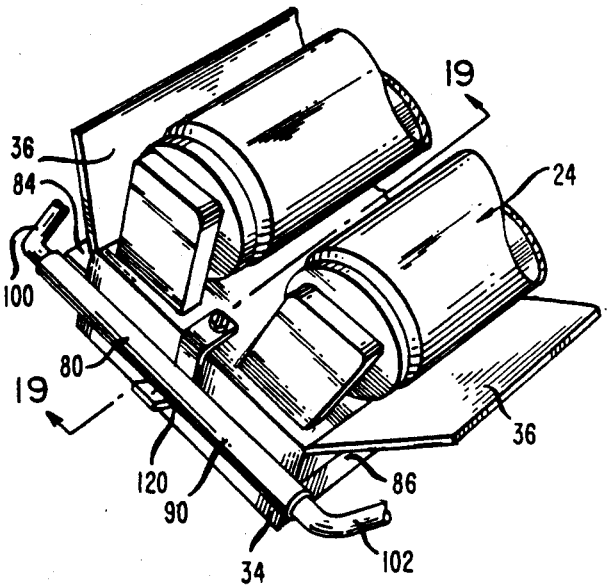
FIG. 18

FLOOR LAMP APPARATUS

BACKGROUND OF THE INVENTION

1. Field of the Invention

This invention relates generally to lighting apparatus, and more particularly to floor lighting apparatus.

2. Description of the Prior Art

Elongated lightbulbs, and particularly fluorescent lightbulbs, are desirable light sources because they provide a more even distribution of light. Most commonly, fluorescent lights must be suspended from a ceiling or other overhead structure. Overhead mounting, however, does not generally permit variation in the position of the lightbulb relative to the illuminated area. Small fluorescent light units have been constructed which are adapted to be placed onto the floor or other surface, and which can be moved around the work area as necessary. These portable units generally are not large enough to adequately illuminate a sizable work area. Also, it is usually not possible to adjust the orientation of the elongated lightbulb to thereby adjust the illumination in the illuminated space.

SUMMARY OF THE INVENTION

It is an object of the invention to provide a floor lamp which will thoroughly illuminate a work area.

It is still another object of the invention to provide a floor lamp apparatus which will be portable.

It is yet another object of the invention to provide a floor lamp apparatus which supports a fluorescent light above a surface and at alternate angles relative to the surface.

It is still another object of the invention to provide a floor lamp apparatus from which the light source can be detached and used for other purposes.

It is still another object of the invention to provide a floor lamp apparatus that can be conveniently stored.

These and other objects are accomplished by a floor lamp apparatus for mounting elongated lightbulbs above a surface. Engagement structure for engaging the elongated lightbulbs is provided. Support means are connected to the engagement structure and are adapted to support the engagement structure and the fluorescent lightbulb above the surface. The apparatus is portable and can be moved about a work area to illuminate the work area as necessary.

The support means is preferably pivotally connected to the engagement structure for convenient folding and storage. The apparatus is preferably substantially triangular, with first and second sides of the triangle forming the support means. The engagement structure is provided at the third side of the triangle, and the elongated lightbulb will be disposed along the third side. The included angles between sides are preferably 90 degrees or less, and are different from one another, such that the apparatus can rest on either of the first or second sides, and thereby support the elongated light at alternative angles relative to the surface.

The elongated lightbulb is preferably fluorescent, and of the type that is mounted to an elongated channel housing. The channel housing usually contains the ballast, switches, and other apparatus necessary for operation of the light. A longitudinal shield is sometimes provided on each side of the channel housing to reflect light in the desired direction. This fluorescent light construction is typically suspended from a ceiling or other overhead support, however, the invention provides a means for supporting such a fluorescent light unit above a surface.

The engagement structure is preferably a cradle adapted for substantially circumferential engagement of the channel housing. The cradle can be formed by a substantially rectangular frame, having lateral side portions and longitudinal end portions. The first and second support sides of the triangle can also each comprise a substantially rectangular framework of lateral side members and longitudinal end members. Adjacent sides of the triangular apparatus preferably share common longitudinal end members.

Adjacent sides of the triangular apparatus are preferably pivotally or detachably connected to the shared longitudinal end members. In this manner, the apparatus can be detached and folded for convenient storage. In a most preferred embodiment, the lateral side members of the first and second support sides are disengageable from the third side, and are pivotally connected to one another about a shared longitudinal end member. At least one of the first and second sides can thereby be disconnected from the third side, and the first side and the second side can be pivoted against one another second side for convenient storage.

BRIEF DESCRIPTION OF THE DRAWINGS

There are shown in the drawings embodiments which are presently preferred, it being understood, however, that the invention is not limited to the precise arrangements and instrumentalities shown, wherein:

FIGS. 13*a–d* are sequential perspective views showing the disconnection and folding of an apparatus according to the invention.

FIG. 14 is a side elevation of a mounting apparatus according to the invention in a folded configuration.

FIG. 15 is a plan view of a mounting apparatus according to the invention in a folded configuration.

FIG. 16 is a perspective view of a fluorescent light assembly according to the invention and resting on a first support side.

FIG. 17 is a perspective view of the fluorescent light assembly of FIG. 16, and resting on a second support side.

FIG. 18 is an enlarged perspective of area E in FIG. 16.

FIG. 19 is a cross-section taken along line 19—19 in FIG. 18.

DETAILED DESCRIPTION OF THE PREFERRED EMBODIMENTS

Figure 1:
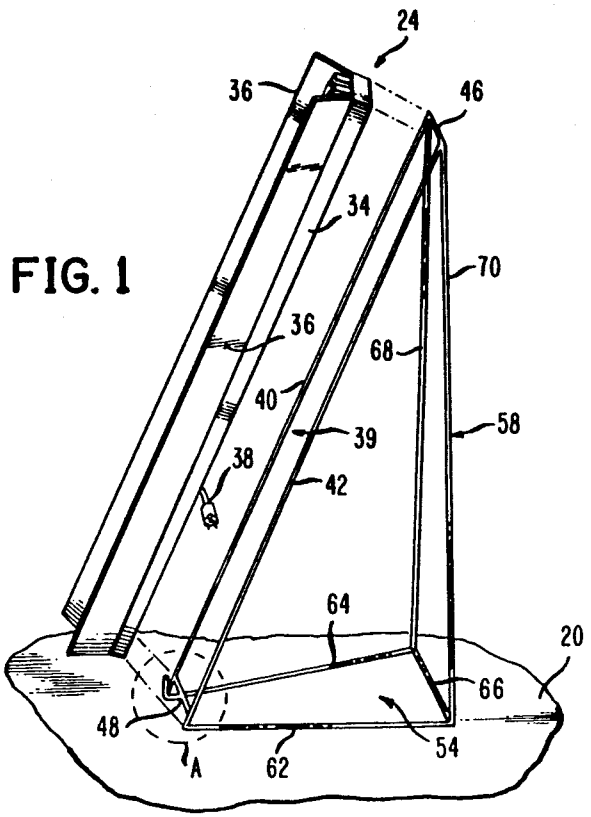
FIG. 1 is an exploded perspective of a floor lamp apparatus according to the invention.
Figure 2:
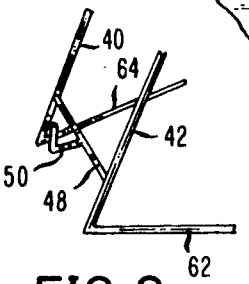
FIG. 2 is an enlarged view of area A in FIG. 1.
Figure 3:
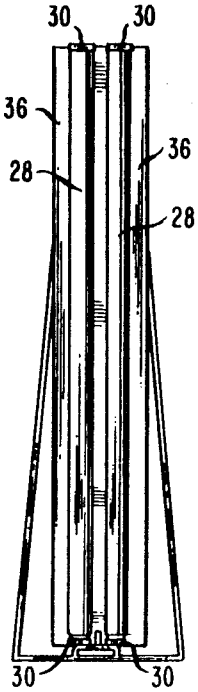
FIG. 3 is a front elevation.
Figure 4:
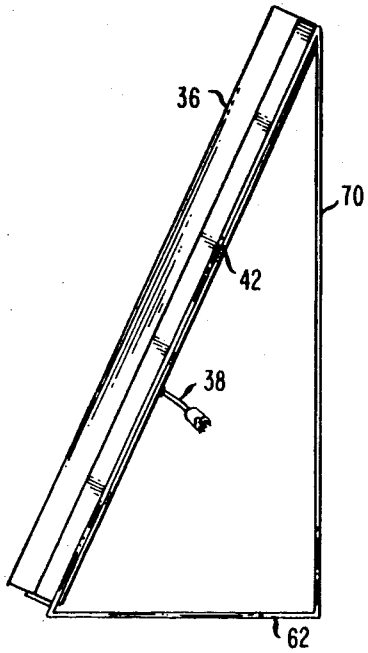
FIG. 4 is a side elevation.
Figure 5:
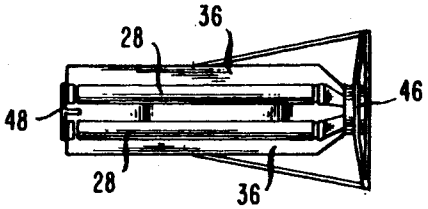
FIG. 5 is a plan view.
Figure 6:
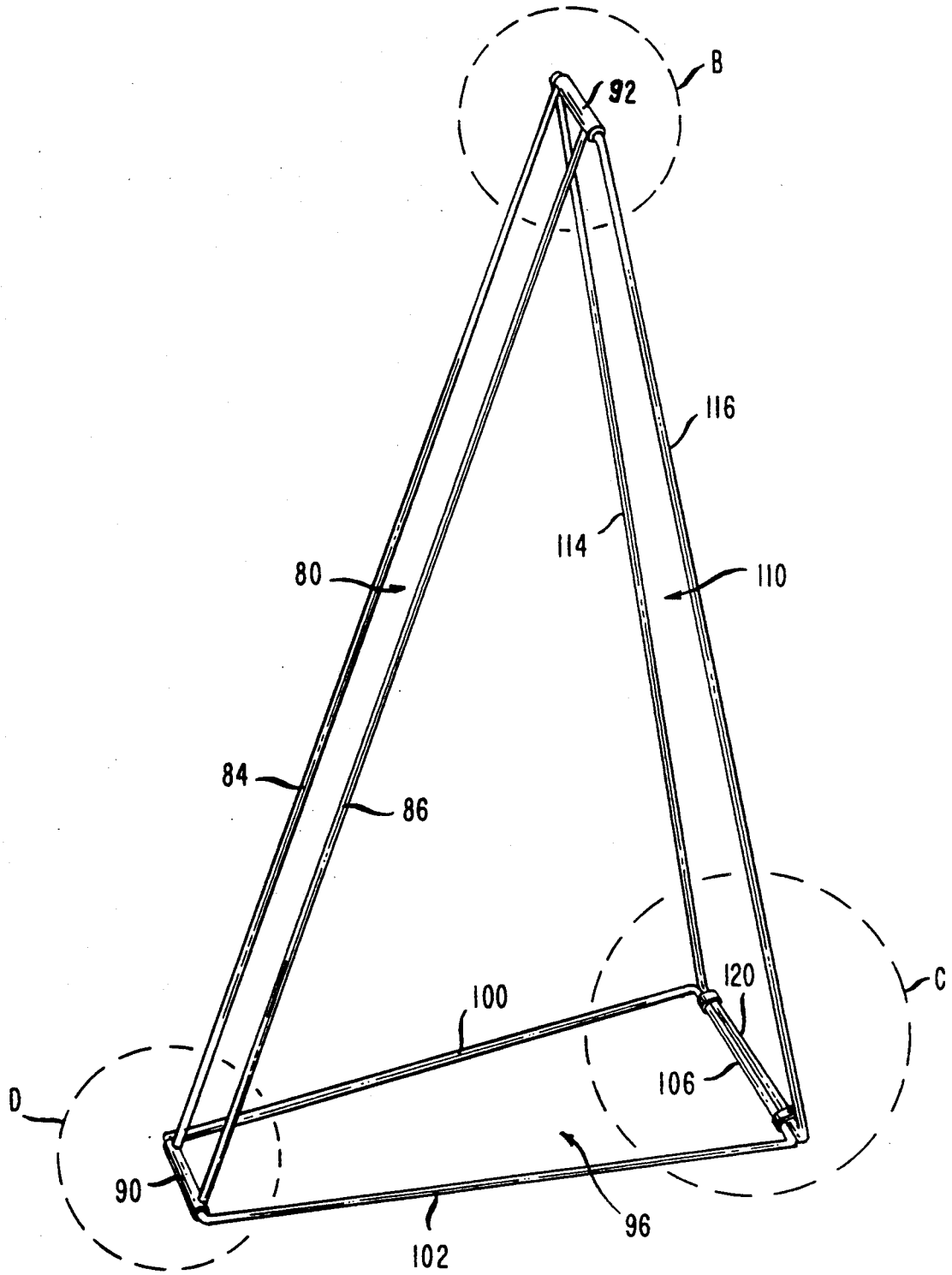
FIG. 6 is a perspective view of a second embodiment of an apparatus according to the invention.
Figure 8:
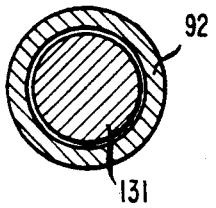
FIG. 8 is a cross-section taken along line 8—8 in FIG. 7.

There are shown in FIGS. 1–5 a first embodiment of the invention. The invention provides an apparatus for supporting an elongated lightbulb above a surface 20. The elongated lightbulb is preferably a fluorescent lightbulb, which can be engaged to the apparatus by suitable means. In a preferred embodiment, a detachable fluorescent light unit 24 is provided. The fluorescent light unit 24 will typically have one or more elongated fluorescent lightbulbs 28 fixed between opposing electrical contacts 30. The lightbulbs 28 and contacts 30, in many fluorescent light units, are mounted to an elongated channel housing 34, which can enclose the ballast, switch and other electrical apparatus included with the light. Elongated longitudinal shields 36 are also sometimes provided on each lateral side of the channel housing 34 to deflect light in a desired direction. An electrical cord 38 can be provided for connection to an appropriate electrical energy source.

Engagement structure is provided for engaging the fluorescent light unit 24, and support structure is provided for supporting the fluorescent light unit 24 above the surface 20. The structure for engaging the fluorescent light unit 24 is preferably a cradle adapted to receive and engage the channel housing 34. The cradle can comprise a rectangular framework 39 of lateral side members 40, 42 and longitudinal end members 46, 48. The frame is dimensioned such that the channel housing 34 nests snugly within the framework of the lateral side members 40, 42 and longitudinal end members 46, 48. A hooked protrusion 50 can be provided on the lower longitudinal end member 48 (FIG. 2) to substantially prevent the fluorescent light unit 24 from falling out of the cradle.

In a preferred embodiment, the cradle and support structure are joined together in a substantially triangular configuration. A first support side 54 and second support side 58 of the triangular apparatus are joined to the cradle framework 39 and to each other at ends thereof.

The first side 54 and second side 58 preferably are formed by a framework of lateral side members and longitudinal end members. The first side 54 can be formed by lateral side members 62, 64, the longitudinal end member 48, and a longitudinal end member 66. The second side 58 can be formed by lateral side members 68, 70. The second side 58 can be joined to the first side 54 about a common longitudinal end member 66, and to the cradle framework 39 about the longitudinal end member 46. The longitudinal end member 66 has greater length than the longitudinal end members 46 or 48. The first side 54 and second side 58 will thereby have an increasing width with increasing distance from the cradle framework 39 to provide a stable support for the fluorescent light unit 24.

The apparatus can rest on either of the first side 54 or second side 58 to support the fluorescent light unit 24 above the surface 20. The included angles between the first side 54, second side 58 and the cradle framework 39 are preferably 90 degrees or less so that the fluorescent light unit 24 will be inclined off of the vertical when resting in the cradle framework 39. This will prevent accidental disengagement.

The apparatus can rest on either of the first side 54 or second side 58. It is preferable to provide different included angles between the cradle framework 39 and each of the first side 54 and second side 58. It will thereby be possible to incline the elongated fluorescent light unit 24 at different angles relative to the surface 20 by resting the unit on either the first side 54 or the second side 58. These included angles most preferably are between about 20–30 degrees and 60–70 degrees. The included angle between the first side 54 and the second side 58 is preferably substantially a right angle, and normally will be between about 70–110 degrees. The length of the sides will be selected to correspond to the size of the fluorescent light unit to be supported, as well as the desired angles.

The support structure can comprise a number of alternative constructions suitable for this purpose. A single back brace in the form of the second side 58 can be connected to a top portion of the cradle framework to support the fluorescent light unit 24 in an upright position. Alternatively, a single base piece in the form of the first side 54 could be engaged to a bottom portion of the cradle to hold the cradle and the fluorescent light unit 24 in an upright position.

The invention can be made of a number of rigid materials suitable for this purpose. Preferably, the invention is manufactured from a durable metal such as steel or aluminum. The thickness should be suitable for rigidity and durability. Rods of at least $\frac{1}{4}$ inch in diameter are presently preferred. High-strength plastics are also possible construction materials.

It is preferred to provide an apparatus which will fold for convenient carrying and storage. Such an embodiment is shown in FIGS. 6–19. This embodiment also preferably comprises a fluorescent light unit 24, and a triangular supporting apparatus with a cradle framework 80 forming a third side thereof. The cradle framework 80 can be constructed from a framework of elongated frame members, in this instance lateral side members 84, 86 and longitudinal end members 90, 92. A first triangular side portion 96 comprises lateral side members 100, 102, which are joined together by the longitudinal end member 90 at one longitudinal end thereof, and by a longitudinal end member 106 at an opposite longitudinal end thereof. A second triangular side portion 110 can include lateral side members 114, 116, which can be joined together at one end by the longitudinal end member 92, and by a longitudinal end member 120 at an opposite end.

Figure 7:
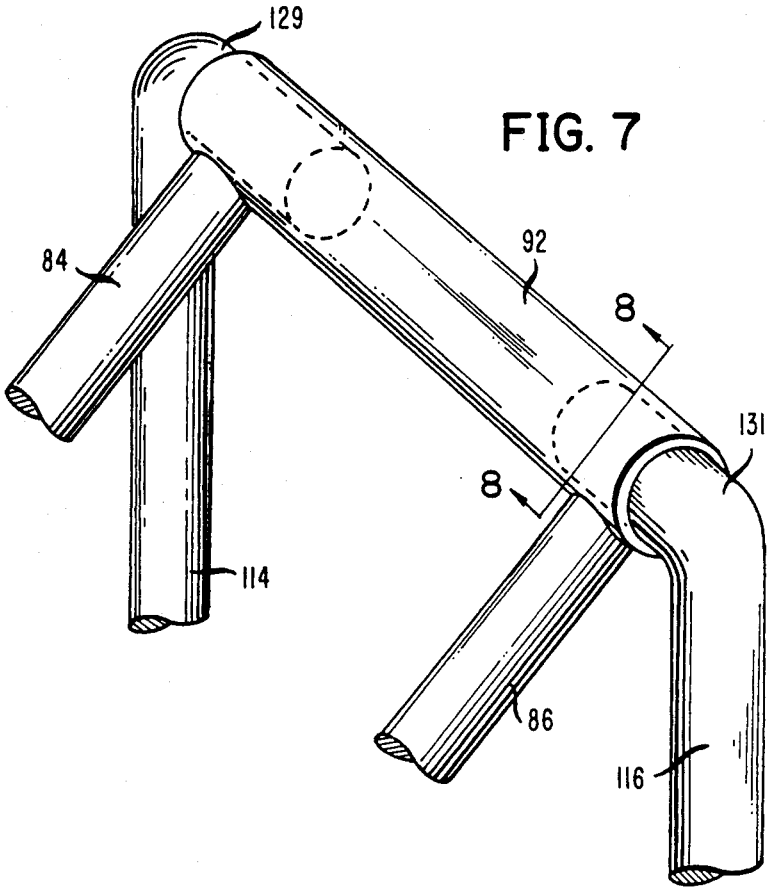
FIG. 7 is an enlarged perspective of area B in FIG. 6.
Figure 11:
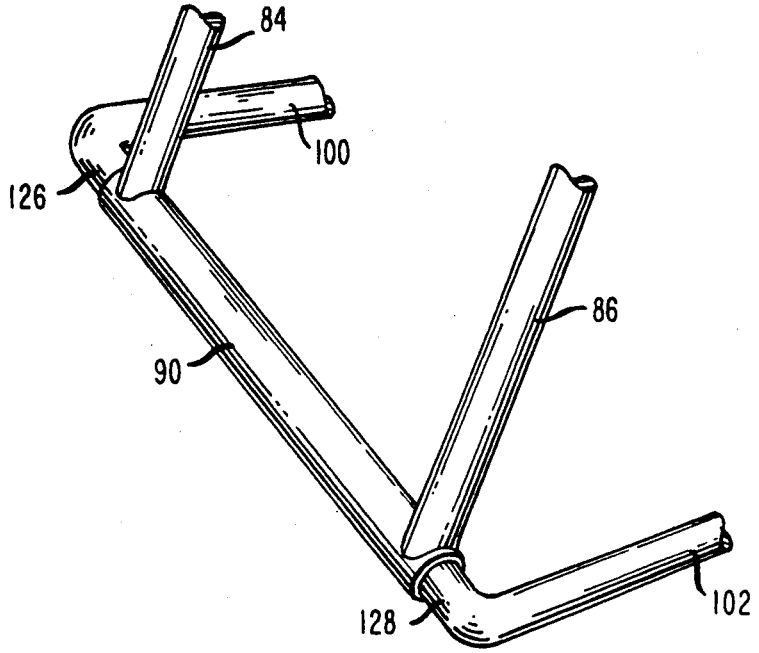
FIG. 11 is an enlarged perspective of area D in FIG. 6.
Figure 12:
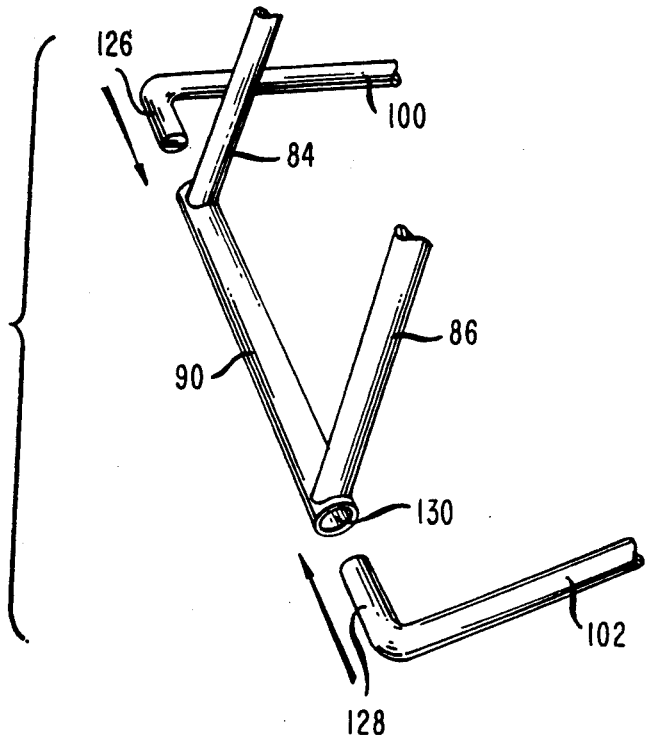
FIG. 12 is an exploded perspective view of area D in FIG. 6.

The longitudinal end members 90, 92 are preferably tubular in configuration. The lateral side portions 100, 102 have folded-over, substantially perpendicular tab portions 126, 128 respectively. The tab portions 126, 128 are adapted to fit into and engage open ends 130 of the tubular longitudinal end member 90 (FIGS. 11–12). Opposite ends of the lateral side members 100, 102 are rigidly joined by the longitudinal end member 106. Similarly, tab portions 129, 131 can be provided at the longitudinal ends of the lateral side portions 114, 116 respectively, to engage open ends of the tubular longitudinal end member 92 (FIG. 7).

Figure 9:
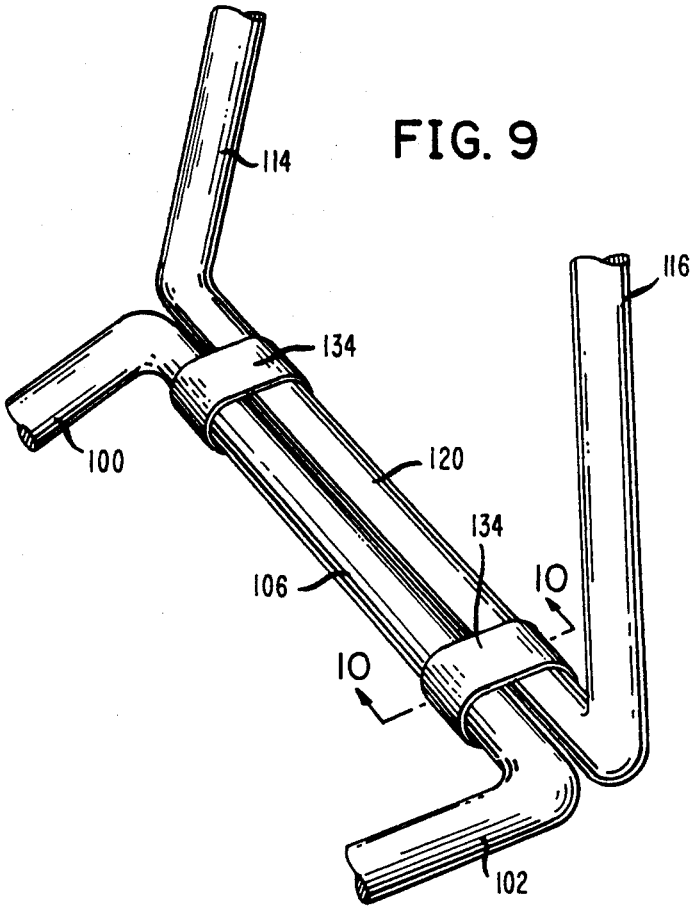
FIG. 9 is an enlarged perspective of area C in FIG. 6.

The longitudinal end member 106 is pivotally joined to the longitudinal end member 120 to provide a pivotal connection between the first triangular side portion 96 and the second triangular side portion 110. Circumferential cuffs 134 can wrap around both of the longitudinal end member 106 and the longitudinal end member 120 (FIG. 9). The cuffs 134 are welded to one of the longitudinal end members, such as by the weld 136 joining the cuff 134 to the longitudinal end member 120

Figure 10:
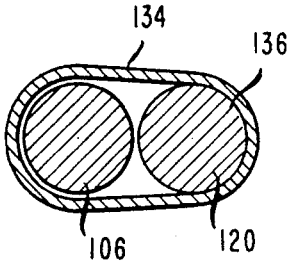
FIG. 10 is a cross-section taken along line 10—10 in FIG. 9.

(FIG. 10). The longitudinal end member 106 is thereby pivotally secured within the cuff 134.

The first triangular side portion 96 and second triangular side portion 110 are pivotal with respect to one another, and can be disconnected from the respective longitudinal end members 90, 92 by removal of the respective perpendicular tab portions from engagement with the open ends of the tubular longitudinal end members 90, 92. The apparatus can thereby be broken down for convenient storage as depicted in FIG. 13*a–d*. The lateral side members 100, 102 are first disconnected from the longitudinal end member 90 (FIG. 13*b*). The third side 80 is then folded against the second support side 110 (FIG. 13*c*). The first support side 96 can then be folded downward against the third side 80 (FIG. 13*d*) to provide a substantially flat configuration for convenient transportation and storage (FIGS. 14–15). It is alternatively, or additionally, possible to disconnect the lateral side members 114, 116 of the second support side 110 from engagement with the second longitudinal end member 92.

The invention provides a portable means for directing the illumination of a fluorescent light unit 24 in alternative directions. The fluorescent light unit 24 is substantially upright when the apparatus rests on the first support side 96, as shown in FIG. 16. This will provide good illumination at or near the ground level. Should it be desired to direct the illumination upwards from the floor, the apparatus can be turned to rest on the second triangular support side 110, as shown in FIG. 17. The angle at which the fluorescent light unit 24 is supported relative to the ground can be changed by changing the lengths of either of the first support side 96 and the second support side 110.

The fluorescent light unit 24 will typically be securely engaged within the cradle of the third side 80. It is preferable, however, to provide structure which will help to engage the channel housing 34 to the third side 80. This structure can be a substantially S-shaped clip 120, which can be attached to the channel housing 34 by suitable fastening means such as the screw 122. The S-shaped clip 120 is adapted to be positioned behind the longitudinal end member 90. Another S-shaped clip can be provided at an opposite end of the channel housing 34 to engage the longitudinal end member 92. The S-shaped clips help to prevent disengagement of the fluorescent light unit 24 from the third side 80, particularly in positions where the fluorescent light unit 24 is angled close to the vertical.

The invention is particularly adaptable for supporting independent fluorescent light units such as the fluorescent light unit 24, of the type manufactured by several companies, such as the Model 24800, Lakewood Manufacturing Co., Chicago, Ill. It will be appreciated, however, that the invention could be adapted to engage different light constructions with appropriate modification of the means for engaging the particular light structure. The invention is capable of still further modification without departing from the spirit or essential attributes thereof, and accordingly, reference should be had to the following claims, rather than to the foregoing specification, as indicating the scope of the invention.

I claim:

1. Portable apparatus for mounting above a surface fluorescent light units of the type having elongated fluorescent light bulbs and an elongated channel housing for engaging the fluorescent light bulbs, said apparatus comprising:

engagement means for engaging the channel housing of the fluorescent light unit; and support means for supporting said engagement means and the fluorescent light unit above said surface, said apparatus being substantially triangular, first and second sides of said triangular apparatus comprising said support means, a third side of said triangular comprising said channel housing engagement means, included angles between said first and second sides, and said third side, being different and acute, whereby said fluorescent light unit can be engaged by said engagement means and supported above said surface by said support means to provide a portable source of illumination, and whereby said apparatus can rest on either of said first and second sides, and said third side and said fluorescent light unit can be supported at alternative angles relative to said surface.

2. The mounting apparatus of claim 1, wherein said engagement means comprises cradle means adapted to receive said channel housing.

3. The mounting apparatus of claim 2, wherein said cradle means comprises a substantially rectangular frame, said rectangular frame being dimensioned such that said channel housing will nest snugly within said rectangular frame.

4. The mounting apparatus of claim 2, wherein said sides of said triangular each comprise first and second substantially co-planar lateral side members, longitudinal ends of said lateral side members being joined by longitudinal end members, adjacent sides of said triangular mounting apparatus sharing common end members, said lateral side members and longitudinal end members of said third side forming cradle means adapted to receive said channel housing of said fluorescent light unit.

5. The mounting apparatus of claim 1, wherein said first and second sides of said triangular apparatus are pivotally connected to said third side and pivotally connected to one another, and at least one of said first and second sides is detachable from said third side, whereby said mounting apparatus can be folded for convenient storage.

6. A fluorescent light assembly, comprising:

a fluorescent light unit having at least one elongated fluorescent lightbulb mounted to an elongated channel housing;

apparatus for mounting said fluorescent light unit above a surface, said apparatus comprising engagement structure for engaging the channel housing of said fluorescent light unit, and support structure for supporting the engagement structure and the fluorescent light unit above said surface, said mounting apparatus being substantially triangular, first and second sides of said triangular apparatus comprising said support means, a third side of said triangle comprising said channel housing engagement structure, included angles between each of said first and second sides, and said third side being different and acute, whereby said mounting apparatus can rest on either of said first and second sides, and said third side and said fluorescent light unit can be supported at alternative angles relative to said surface.

7. The mounting apparatus of claim 6, wherein said engagement means comprises cradle means adapted to receive said channel housing.

8. The mounting apparatus of claim 7, wherein said cradle means comprises a substantially rectangular frame, said rectangular frame being dimensioned such that said channel housing will next snugly within said rectangular frame.

9. The mounting apparatus of claim 7, wherein sides of said triangle each comprise first and second substantially co-planar lateral side members, longitudinal ends of said lateral side members being joined by longitudinal end members, adjacent sides of said triangular mounting apparatus sharing common longitudinal end members, said lateral side members and longitudinal end members of said third side forming said cradle means adapted to receive said channel housing of said fluorescent light unit.

10. The mounting apparatus of claim 6, wherein said first and second sides of said triangle are pivotally connected to and detachable from said third side and pivotally connected to one another, whereby said mounting apparatus can be folded for convenient storage.

11. A floor lamp, comprising:

an elongated lightbulb and structure for engaging said lightbulb, said engagement structure comprising means for supplying an electric current to said lightbulb;

a substantially triangular support for said lightbulb and said lightbulb engagement structure, first and second sides of said triangle forming said support structure, said elongated lightbulb being fixed to a third side of said triangle, included angles between each of said first and second sides and said third side being acute and different from one another, whereby said elongated lightbulb can be supported above said surface on either of said first or second side, and at a different angle relative to said surface.

12. The mounting apparatus of claim 9, wherein said first and second sides of said triangular support are pivotally connected to and detachable from said third side and pivotally connected to one another, whereby said mounting apparatus can be folded for convenient storage.

* * * * *